US005645319A

United States Patent [19]

Parks, Jr.

[11] Patent Number: 5,645,319

[45] Date of Patent: Jul. 8, 1997

[54] PASSENGER'S PILLOW

[76] Inventor: Robert R. Parks, Jr., 2415 Midway Rd. #101, Carrollton, Tex. 75006

[21] Appl. No.: 403,184

[22] Filed: Mar. 13, 1995

[51] Int. Cl.[6] ..... A47C 7/38; A47C 7/62

[52] U.S. Cl. ..... 297/391; 297/146; 297/392; 297/452.41; 5/644; 5/655.3

[58] Field of Search ..... 297/112, 146, 297/163, 391, 392, 395, 397, 452.41, 243; 5/644, 655.3

[56] References Cited

U.S. PATENT DOCUMENTS

| | | | |
|---|---|---|---|
| 2,343,996 | 3/1944 | Perry | 5/655.3 X |
| 2,612,645 | 10/1952 | Boland | 5/644 X |
| 2,877,472 | 3/1959 | Wagner | 5/337 |
| 3,568,227 | 3/1971 | Dunham | 5/644 X |
| 4,002,108 | 1/1977 | Drori | 297/180.13 X |
| 4,235,472 | 11/1980 | Sparks et al. | 297/392 |
| 4,287,621 | 9/1981 | Kertz | 5/440 |
| 4,928,336 | 5/1990 | Petillo, Sr. | 5/644 |
| 5,004,294 | 4/1991 | Lin | 297/180.13 X |
| 5,528,783 | 6/1996 | Kunz et al. | 5/644 X |

FOREIGN PATENT DOCUMENTS

| | | | |
|---|---|---|---|
| 643128 | 5/1984 | Switzerland | 5/644 |

*Primary Examiner*—Peter R. Brown
*Attorney, Agent, or Firm*—Fulbright & Jaworski L.L.P.

[57] ABSTRACT

An inflatable pillow on which passengers seated in rows of forward-facing seats may lean forward, rest their heads, and relax. The pillow's shape, once inflated, is predetermined to substantially occupy the space in front of such passengers. In one embodiment, the predetermined shape includes faces that fit snugly against a support means, such as a tray table, and abuts against a vertical restraint, such as the back of the seat in front. The predetermined shape nonetheless allows the vertical restraint to recline towards the pillow without causing the pillow to move. In another embodiment, the predetermined shape includes a plurality of flexibly connected cells that may be folded to form a shape that substantially occupies the available space while still allowing the seat in front to recline. A means is also included to inflate the pillow optionally with air supply from an external climate control near the passenger such as an air conditioning vent, where such an external climate control is available.

10 Claims, 3 Drawing Sheets

PASSENGER'S PILLOW

BACKGROUND OF THE INVENTION

It is well recognized among regular passengers on commercial carriers that it is often difficult to relax in the seats provided. In particular, economy class seating on aircraft and buses typically provides closely-spaced forward-facing seats in rows separated by a very small space. These seats severely restrict the passenger's movement out of the sitting position, causing fatigue and discomfort during the journey.

A common feature of economy class seating is the fold-down tray table presented to the passenger by the back of the seat in front. Passengers have been known to seek relief from the discomfort of their seats by leaning forward and resting their heads on a conventional pillow placed on the tray table in front. This practice does not always give the passenger the relief sought, however, especially when the pillow is too small to fit conveniently on the tray table, or when the pillow is too soft to prevent the passenger from feeling the tray table through the pillow. Moreover, a passenger relaxing in this way risks being disturbed when the seat in front is reclined, since in order to be reclined, the seat in front must necessarily be forced backwards into the space in which the passenger is trying to relax.

There has therefore been a long-felt but unsolved need for a pillow that meets the needs of a passenger trying to relax in the confined space afforded by typical economy class seating. The present invention addresses this need by providing a pillow that is placed in the space immediately in front of the passenger, and whose shape and size provide a comfortable surface on which to lean forward and relax. Further, the shape of the pillow is designed so that its normal operating position will remain substantially unaffected by any reclining movement of the seat in front.

Since passengers typically are able to carry only a limited amount of hand luggage, the present invention is also directed to an inflatable pillow which, when deflated, may easily be folded up and carried conveniently in another bag, or even a coat pocket, when not in use. It is contemplated, however, that passengers short of breath may experience difficulty inflating a pillow when seated. The present invention therefore also includes an optional flexible tube that will connect the valve in the pillow remotely to an external climate control near the passenger, such as an air conditioning vent, so that air supply from the external climate control may be used to inflate the pillow. This previously unsuggested combination of deflatability for ease of transport and then inflatability, optionally from a nearby climate control, is a synergistic improvement over the prior art.

The present invention is further directed to a pillow whose shape is predetermined to fit into the space in front of a passenger sitting in rows of forward-facing seats. In one embodiment, the shape, when substantially inflated, has at least two faces, one of which rests snugly on a support such as a tray table, the other sculpted to abut against the seat in front while leaving space for the seat in front to recline into. In another embodiment, flexibly connected cells fold to form a shape that substantially occupies the available space in front of the passenger while still leaving room for the seat in front to recline into.

Although pillows on which the user may lean forward and rest the head are known in the art, the present invention is distinguishable from previous designs suggesting this application. Kertz, U.S. Pat. No. 4,287,621, for example, discloses a steering wheel attachment that provides a foam pad pillow on which drivers may rest the arms and head. The present invention is distinguishable in that Kertz is directed to a specific, semicircular pillow enabling drivers to rest on their steering wheels. In contrast, the present invention is directed and adapted for the needs of passengers trying to relax in forward-facing rows of seats. Further, Kertz is not inflatable. Another design variation is disclosed in Sparks et al., U.S. Pat. No. 4,235,472, which is directed to a multi-purpose resting and storage device of modular construction that may also be placed in the lap of a sitting person to provide support for the chin. The present invention is distinguishable from and improves on Sparks by being deflatable. The present invention may thus be deflated, folded up and transported by the passenger much more conveniently when not in use. Further, unlike the present invention, Sparks makes no provision to prevent the user from being disturbed when a seat in front is reclined. In yet another variation, Wagner, U.S. Pat. No. 2,877,472, is directed to a solid pillow, disclosing three flexibly-connected segments that fold together. The embodiment of the present invention that discloses a plurality of flexibly-connected cells is distinguishable in that it is deflatable and is therefore more conveniently stored and transported by the passenger.

SUMMARY OF THE INVENTION

As noted, it is an object of the present invention to provide a pillow to improve the comfort of passengers, particularly those travelling on commercial carriers where the space in which to relax is limited.

It is a further object of the present invention to provide a pillow that is inflatable for ease of carrying and storage. When the present invention is fully deflated, it is contemplated that the passenger will be able to fold it up and carry it in a brief case, a hand bag, or even in a trouser or coat pocket.

As a corollary to being deflatable for ease of carrying and storage, it is also an object of the present invention to provide an optional means for remote inflation using air supply from an external climate control such as a heating or air conditioning vent. Where such external climate controls are available, this option will enable the invention to be inflated quickly and conveniently by passengers who are possibly short of breath.

It is another object of the present invention to provide a pillow whose shape is adapted to fit in the space in front of the passenger so that he or she may lean forward and rest his or her head thereon.

It is a further object of the present invention to provide a pillow that, when in use, will remain substantially unaffected by reclining movement of the seat in front.

It is a further object of the present invention to provide an inflatable airtight pillow whose design is strong and reliable in use, and yet easy and inexpensive to manufacture.

These and other objects of the present invention will be apparent to those skilled in this art from the detailed description of a preferred embodiment of the invention set forth below.

BRIEF DESCRIPTION OF THE DRAWINGS

This invention will be further described in connection with the accompanying drawings, in which.

DETAILED DESCRIPTION OF THE INVENTION

Figure 1:
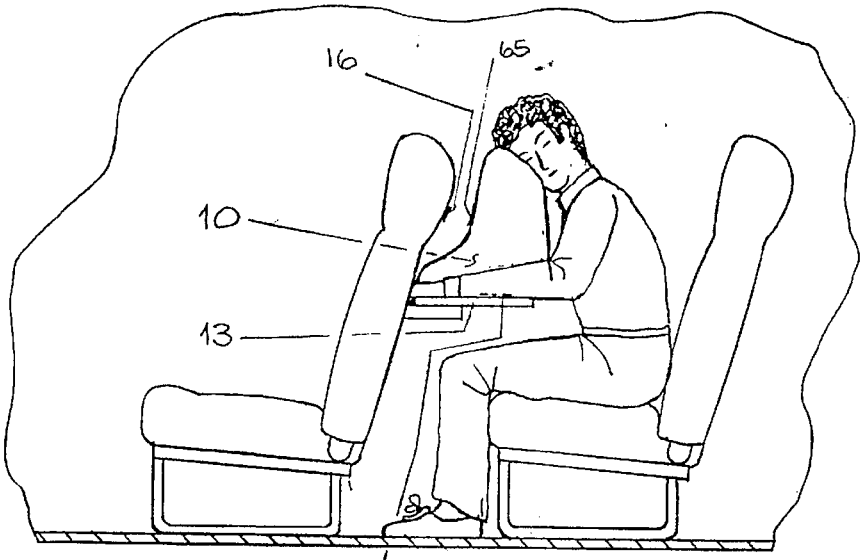
FIG. 1 is a general arrangement illustrating a passenger relaxing by placing his head on the pillow. It will be seen that the pillow occupies the space available to the passenger above external support means 13 and in front of external vertical restraint 16.

A first preferred embodiment of the present invention is illustrated on FIGS. 1, 2, 3, and 4. FIG. 1 shows a passenger using inflatable airtight chamber 10 to rest his head and relax while travelling. External support means 13, such as a tray table, supports inflatable airtight chamber 10, while external vertical restraint 16, such as the back of the seat in front, prevents inflatable airtight chamber 10 from moving away from the passenger while in use.

Figure 2:
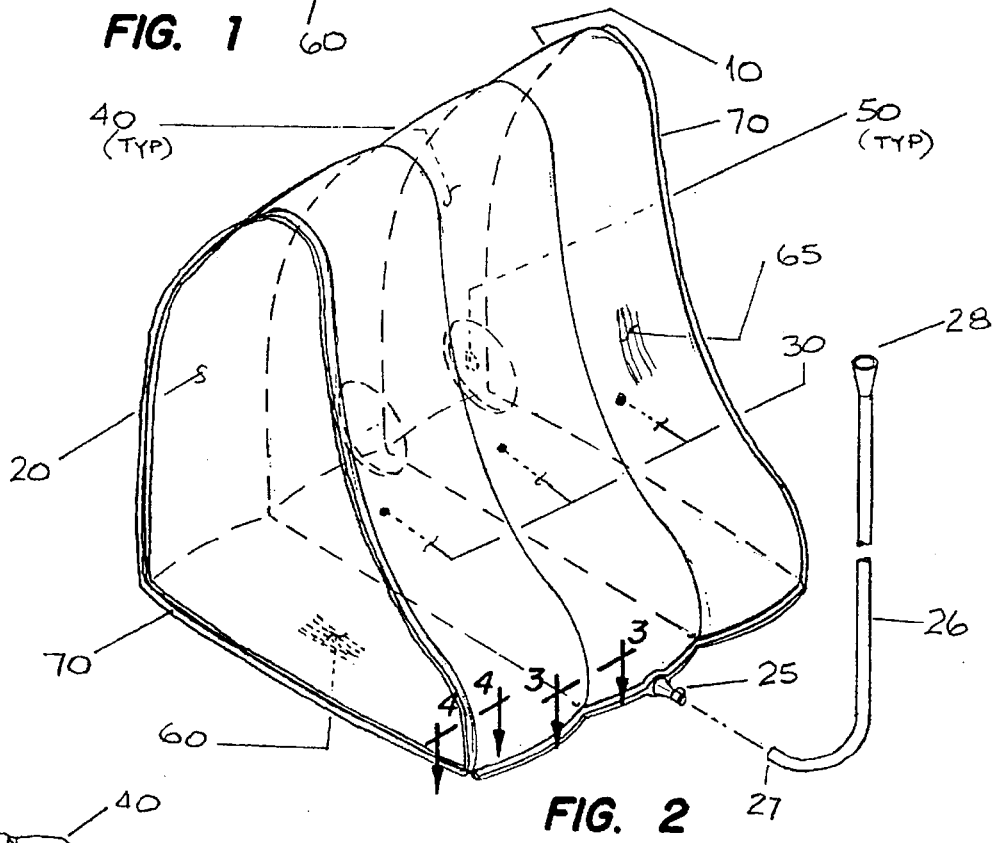
FIG. 2 is a perspective view of the pillow showing its compartmentalized structure. The means for remote inflation is also depicted.
Figure 3:
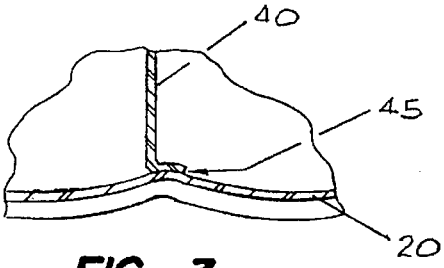
FIG. 3 is a typical section through the point of attachment of internal partitions 40 to outer chamber 20 as shown on FIG. 2.

As shown in more detail on FIG. 2, inflatable airtight chamber 10 has outer chamber wall 20. Valve 25 is provided in outer chamber wall 20 to regulate inflation and deflation of inflatable airtight chamber 10. Also as shown on FIG. 2, flexible tube 26 has a first end 27 adapted to cooperate with valve 25, and a second end 28 adapted to cooperate with a remote environmental ventilation opening such as an air conditioning vent, whereby air supply from the remote environmental ventilation opening can be used to inflate the present invention.

As further shown on FIG. 2, inflatable airtight chamber 10 also has a plurality of internal compartments 30. The preferred embodiment herein contemplates three internal compartments 30, although the present invention has no specific requirement in this regard. Internal compartments 30 are separated by internal partitions 40. As shown in greater detail in FIG. 3, the preferred embodiment herein calls for internal partitions 40 to be attached to the inside surface of outer chamber wall 20 by bond 45. It is contemplated that bond 45 could be achieved by a heat sealing process, by adhesive, by stitching, or by any other suitable process known to those of ordinary skill in this art.

Referring again to FIG. 2, internal compartments 30 are also in airflow communication with each other through openings 50 in each internal partition 40. FIG. 2 illustrates openings 50 as cutouts in internal partitions 40, but the present invention again has no specific requirement in this regard. It is merely required that internal compartments 30 are in airflow communication with each other. This requirement could also be satisfied by deliberately leaving predetermined periodic lengths in bond 45 unsealed.

FIG. 1 and FIG. 2 also disclose inflatable airtight chamber 10 as having a predetermined shape to substantially take up the space offered to a passenger above external support means 13 and in front of external vertical restraint 16. To this end, the outside shape of inflatable airtight chamber 10 has a first face 60 adapted to rest snugly on external support means 13 and a second face 65 sculpted to abut against external vertical restraint 16 while still allowing space for vertical restraint 16 to recline into.

Figure 4:
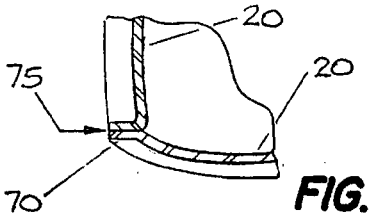
FIG. 4 is a typical section through seams 70 as shown on FIG. 2.

FIG. 4 depicts the preferred method of sealing outer chamber wall 20 to ensure that the present invention is airtight when inflated. Referring back to FIG. 2, inflatable airtight chamber 10 has seams 70 at the points of contact of outer wall 20. As shown on FIG. 4, seal 75 keeps seams 70 airtight. As with bond 45, seal 75 may be accomplished by heat-sealing, adhesive, stitching, or by any other suitable process known to those of ordinary skill in this art.

Figure 5:
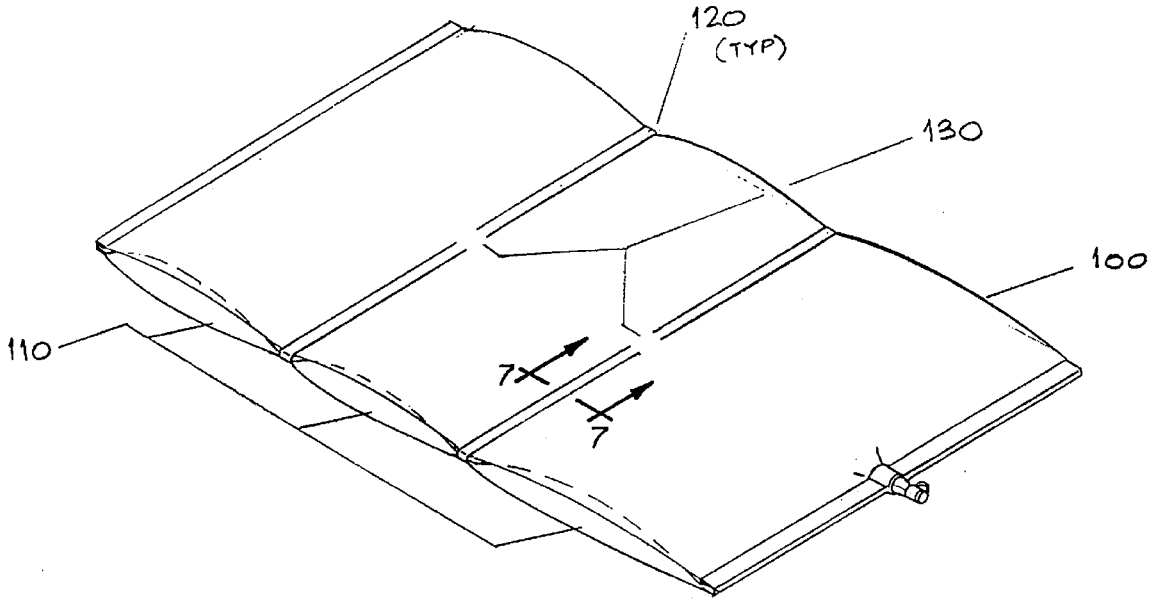
FIG. 5 is a perspective view of an alterative preferred embodiment of the present invention.
Figure 6:
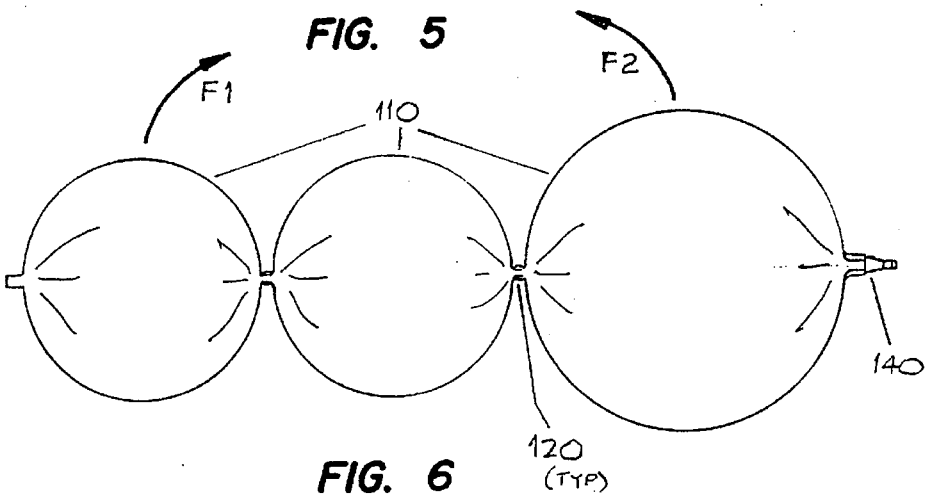
FIG. 6 is a side elevation view of the preferred embodiment depicted in FIG. 5.
Figure 7:
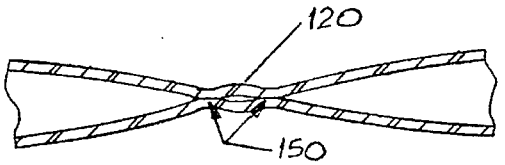
FIG. 7 is a typical section through seams 120 as shown on FIG. 5.

FIGS. 5, 6, 7 and 8 illustrate an alternative preferred embodiment of the present invention. As shown in FIG. 5, inflatable airtight chamber 100 has preferably three cells 110 connected flexibly together by seams 120. In accordance with FIG. 5, cells 110 are again in airflow communication with each other through openings 130 in seams 120, while it will be seen on FIGS. 5 and 6 that inflation and deflation is again regulated by valve 140. FIG. 7 illustrates that seams 120 are again kept airtight by joint 150, using a process such as heat-sealing or adhesive. It is contemplated that flexible tube 26 depicted in FIG. 2 could also be used for remote inflation, although first end 27 would need to be adapted to cooperate with valve 140.

Figure 8:
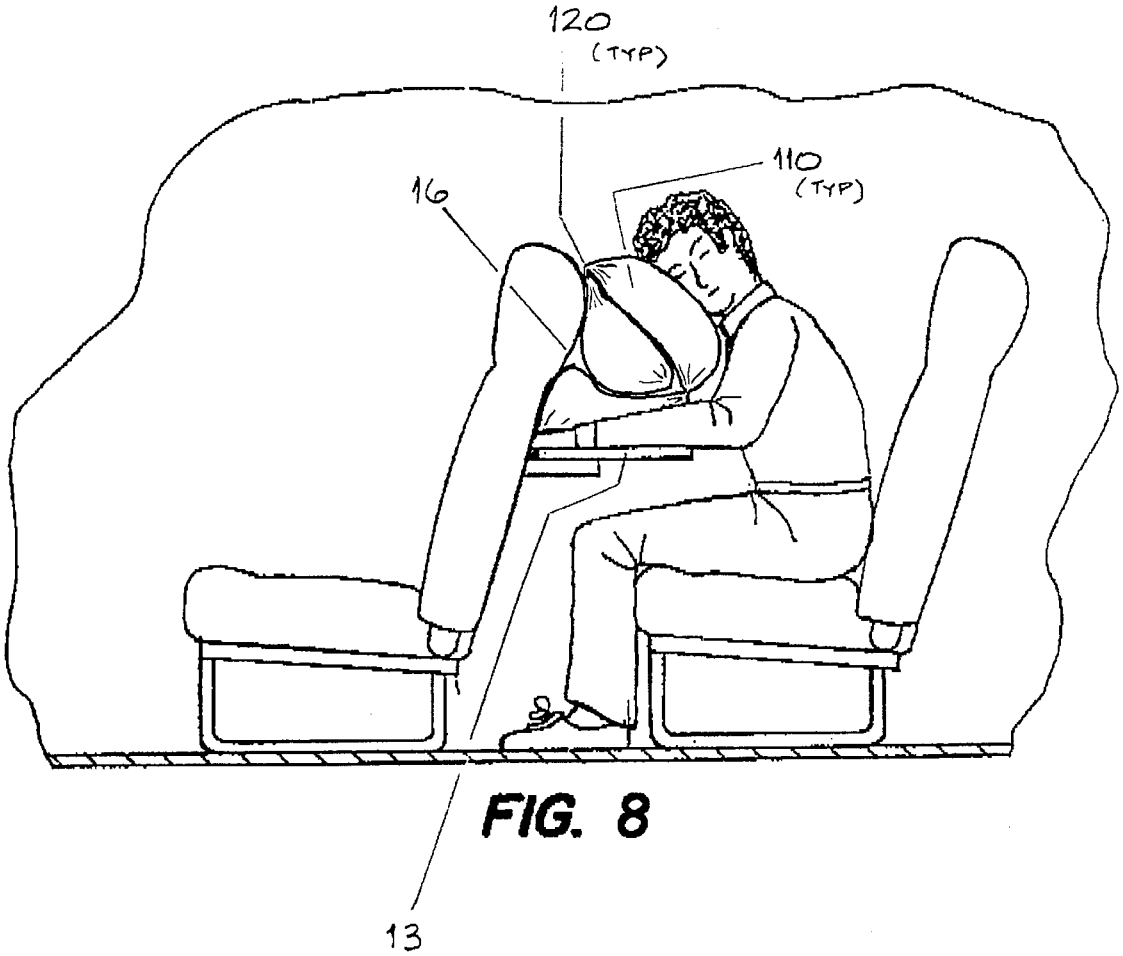
FIG. 8 is a similar view to FIG. 1, except that in FIG. 8, the passenger is using the alternative preferred embodiment of FIG. 5 during relaxation.

As shown on FIG. 8, and by the directional arrows F1 and F2 on FIG. 6, once inflated, cells 110 may be brought together in the directions of F1 and F2 and arranged as in FIG. 8, adopting a shape compatible with the space available to a passenger above external support means 13 and in front of external vertical restraint 16. FIG. 8 shows cells 110 manipulated into the space in front of the passenger with a first face 60 adapted to rest on external support means 13 and a second face 65 adapted to abut external vertical restraint 16 to provide support for the head and upper body on pinnacle surface 66.

The invention has been shown, described and illustrated in substantial detail with reference to a presently preferred embodiment. However, it will be understood by those skilled in the art that changes and modifications may be made without departing from the spirit and scope of the invention which is defined by the claims set forth hereunder.

I claim:

1. In combination, a tandem seating arrangement having a first seat in front of a second seat and a substantially horizontal support surface extending rearwardly from a backrest of said first seat and located above an occupant supporting surface of said second seat, the seating arrangement also including a predefined space between said first and second seats, wherein said predefined space is also bounded in part by said substantially horizontal support surface;

a remote air supply; and a passenger's pillow, the passenger's pillow comprising:

an inflatable airtight chamber, the inflatable airtight chamber having an outer chamber wall, the inflatable airtight chamber divided into a plurality of compartments, the compartments in airflow communication with each other across one or more openings within the inflatable airtight chamber;

a valve, the valve provided in the outer chamber wall, the valve regulating inflation and deflation of the inflatable airtight chamber;

the inflatable airtight chamber also having a predetermined three-dimensional shape when substantially inflated, the predetermined three-dimensional shape being selected so as to be adaptable to rest on the substantially horizontal support surface while operable to support the head of a passenger leaning forward from a sitting position in the second set;

the outer chamber wall made from a plastic material, the plastic material being sealed to form the inflatable airtight chamber using a heat-sealing process; and a flexible tube, the flexible tube having a continuous internal passageway, the flexible tube also having a first end and a second end, the first end of the flexible tube adapted to fit over the valve so as to keep the valve in airflow communication with the continuous internal passageway the second end of the flexible tube adapted to fit over the remote air supply so as to keep the remote air supply in airflow communication with the continuous internal passageway.

2. In combination, a substantially orthogonal horizontal support located at a position spaced above an occupant supporting surface of said seat and extending from a vertical restraint which is in front of and spaced from the seat;

a remote air supply; and a pillow, the pillow comprising:

an inflatable airtight chamber, the inflatable airtight chamber having an outer chamber wall, the inflatable airtight chamber divided into a plurality of compartments, each compartment connected flexibly with at least one other compartment, the compartments also in airflow communication with each other through at least one opening in each compartment;

a valve, the valve provided in the outer chamber wall, the valve regulating inflation and deflation of the inflatable airtight chamber;

the inflatable airtight chamber also having a predetermined three-dimensional shape when substantially inflated, the predetermined three-dimensional shape allowing the compartments to be manipulated into a folded assembly, the folded assembly, once manipulated, having a predetermined folded shape;

the predetermined folded shape adapted to rest on the horizontal support surface, the predetermined folded shape further adapted to abut the vertical restraint surface, the predetermined folded shape presenting a pinnacle surface when the predetermined folded shape is in contact with the horizontal support surface and the restraint surface, the pinnacle surface operable to receive the head of a person sitting in the seat when the person leans forward;

the outer chamber wall made from a plastic material, the plastic material being sealed to form the inflatable airtight chamber using a heat-sealing process; and a flexible tube, the flexible tube having a continuous internal passageway, the flexible tube also having a first end and a second end the first end of the flexible tube adapted to fit over the valve so as to keep the valve in airflow communication with the continuous internal passageway, the second end of the flexible tube adapted to fit over the remote air supply so as to keep the remote air supply in airflow communication with the continuous internal passageway.

3. In combination, a tandem seating arrangement having a first seat in front of a second seat wherein a predefined space is disposed therebetween and is bounded in part by a substantially horizontal support located above a support surface of the second seat and extending from a substantially vertical restraint defined by a backrest portion of said first seat; and a passenger's pillow, the passenger's pillow comprising:

an inflatable airtight chamber, the inflatable airtight chamber having an outer chamber wall, the inflatable airtight chamber also having a predetermined three-dimensional shape when substantially inflated, the predetermined three-dimensional shape selected to occupy the predefined space so as also to be operable to support the head of a passenger leaning forward from a sitting position in said second seat; and a valve, the valve provided in the outer chamber wall, the valve regulating inflation and deflation of the inflatable airtight chamber.

4. The combination of claim 3, further comprising:

a remote air supply; and a flexible tube, the flexible tube having a continuous internal passageway, the flexible tube also having a first end and a second end, the first end of the flexible tube adapted to fit over the valve so as to keep the valve in airflow communication with the continuous internal passageway, the second end of the flexible tube adapted to fit over the remote air supply so as to keep the remote air supply in airflow communication with the continuous internal passageway.

5. The combination of claim 3, wherein the inflatable airtight chamber is divided into a plurality of compartments, the compartments in airflow communication with each other across one or more openings within the inflatable airtight chamber.

6. The passenger's pillow of claim 5, wherein at least one compartment is made from a plastic material.

7. The combination of claim 3, wherein:

the inflatable airtight chamber is divided into a plurality of compartments, each compartment connected flexibly with at least one other compartment, the compartments also in airflow communication with each other through at least one opening in each compartment; and the predetermined three-dimensional shape of the inflatable airtight chamber also allows the compartments to be manipulated into a folded assembly.

8. The combination of claim 3, wherein the outer chamber wall is made from a plastic material.

9. The combination of claim 8, wherein the plastic material is sealed to form the inflatable airtight chamber using a heat-sealing process.

10. The combination of claim 8, wherein the plastic material is sealed to form the inflatable airtight chamber using adhesive.

* * * * *